US007621076B2

(12) United States Patent
Blaisdell

(10) Patent No.: US 7,621,076 B2
(45) Date of Patent: Nov. 24, 2009

(54) BARBERSHOP

(76) Inventor: Everette Blaisdell, 1133 Landeco La., Apt. 210, Grand Forks, ND (US) 58201

( * ) Notice: Subject to any disclaimer, the term of this patent is extended or adjusted under 35 U.S.C. 154(b) by 451 days.

(21) Appl. No.: 11/304,270

(22) Filed: Dec. 14, 2005

(65) Prior Publication Data

US 2006/0137188 A1 Jun. 29, 2006

Related U.S. Application Data

(60) Provisional application No. 60/635,770, filed on Dec. 14, 2004.

(51) Int. Cl.
*E04H 3/00* (2006.01)
*E04B 1/32* (2006.01)
*E04B 7/08* (2006.01)

(52) U.S. Cl. ..... 52/79.1; 52/80.1; 52/81.1; 52/81.4; 52/311.2

(58) Field of Classification Search ..... 52/79.1, 52/79.5, 80.1–80.2, 81.1–81.6, 270, 283, 52/85, 311.1, 311.2; 446/476, 479, 491
See application file for complete search history.

(56) References Cited

U.S. PATENT DOCUMENTS 2,350,904 A * 6/1944 King ..... 52/64
2,733,784 A * 2/1956 Berry ..... 52/81.1
3,436,052 A * 4/1969 Nevarez Ocampo ..... 249/27
3,583,368 A * 6/1971 Mandelhaum et al. ..... 119/603
D223,566 S * 5/1972 Cassano ..... D25/25
3,941,039 A * 3/1976 Kinney ..... 126/299 D
3,968,190 A * 7/1976 Stewart ..... 264/32
4,136,408 A * 1/1979 Dahlbeck et al. ..... 4/448
4,192,454 A * 3/1980 Rugenstein ..... 126/592
4,501,099 A * 2/1985 Boaz ..... 52/82
4,514,938 A * 5/1985 Maguire ..... 52/79.4
4,565,149 A * 1/1986 Clasky et al. ..... 114/264
D288,552 S * 3/1987 Kerns et al. ..... D12/195
5,682,622 A * 11/1997 Tagg ..... 4/449
5,967,632 A * 10/1999 Lamia ..... 312/209
6,295,768 B1 * 10/2001 Romero ..... 52/82

FOREIGN PATENT DOCUMENTS

JP 10121752 A * 5/1998

* cited by examiner

*Primary Examiner*—Jeanette Chapman
(74) *Attorney, Agent, or Firm*—Robert E. Kleve

(57) ABSTRACT

The invention comprises a compact barber shop structure having the exterior shape of a barber pole of sufficient height and size allow adults to enter and move about standing up and has a barber chair in its interior with barbering accessories to enable a barber groom a person's hair while seated in the barber chair. The structure has a door to allow persons to enter the structure for the grooming. The structure has a cylindrical exterior and has spiral stripes applied to the cylindrical exterior of the color common to a barber pole. A large globe is located on top of the cylindrical exterior of type common to a globe of a barber pole.

1 Claim, 5 Drawing Sheets

BARBERSHOP

This invention relates to a portable barbershop structure and the like. This invention also relates to my provisional patent application filed Dec. 14, 2004, U.S. Ser. No. 60/635,770.

It is an object of the invention to provide novel portable barbershop compartment having an exterior shape simulating a barber pole which can be easily moved to different places and which structure has a door providing access to the interior of the barber pole shaped compartment. The interior of the compartment has barber shop equipment including a sink and the like and a barber chair for a person to sit upon while the barber grooms their hair.

It is another object of the invention to provide a novel compact barbershop having the exterior shape of a barber pole including a cylindrical shape with spiral stripes and globe on top and of a size sufficient for adults to stand or be seated on a chair while a barber grooms their hair.

Further objects and advantages of the invention will become apparent as the description proceeds and when taken in conjunction with the accompanying drawings wherein.

Briefly stated the invention comprises a mobile compartment having a general shape of a barber pole including cylindrical sides and barber stripes painted on the exterior cylindrical sides with a white globe on top, said cylindrical compartment being of a size when opened to accommodate persons seated to standing up, and having barbershop facilities within the cylindrical compartment so that it my be used actually as a barbershop, and small enough may be closed together and easily moved to a place for storage when not in use.

Figure 1:
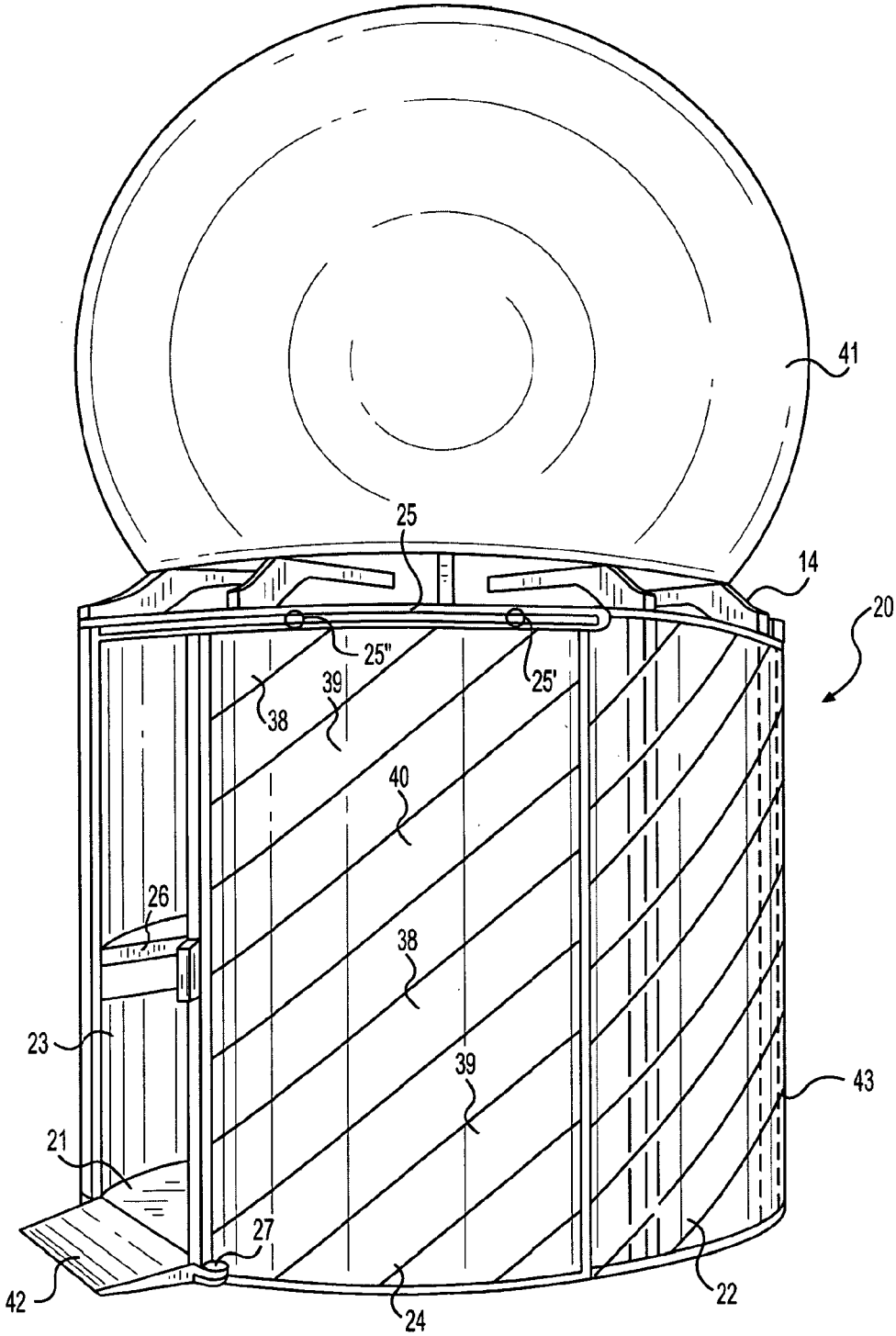
FIG. 1 is a side perspective view of the barber pole shaped barbershop with the door open to the interior.

Referring more particularly to the drawings, in FIG. 1 the mobile barber pole shaped barbershop structure 20 is illustrated having a floor 21 with a circular perimeter with a cylindrical wall 22 extending about the outer edge or perimeter of the floor or base 21. The barbershop structure 20 is of sufficient size and height to allow adults persons to move freely about standing up while grooming hair. An opening or rectangular doorway 23 is provided in the cylindrical wall has a sectional runway or track 25 fixed to the cylindrical wall 22 along the top of the opening to provide a runway for the door 24. A pair of spaced rollers 25' are rotatably mounted to the top of the door 24 and roll in the groove of the c shaped track to provide a rolling top support for the door 24 so that the door 24 may be rolled on its rollers in the groove of the track endwise parallel arcuately along the cylindrical compartment substantially flush along the exterior of the cylindrical wall from a position beside the door opening for opening the doorway to a position across the door opening for closing the doorway.

A roller 26 is mounted along the inner arc of the lower portion of the door 24 to space the door 24 from the cylindrical wall 22 and another roller 27 is rotatably mounted outside the cylindrical wall 22 at its other lower edge to maintain the wall from pivoting too far outward.

A chair 28 is provided in the interior of the cylindrical wall in the approximate center of the floor 21, mounted on the floor 21.

A pair of chord shaped counters 29 and 30 are mounted along the interior of the cylindrical wall 22 on each side of the door opening. The counter 29 has a sink 31 therein. A pair of reservoir containers 32 and 33 are mounted on the floor 21 beneath the counter. A faucet 34 is mounted on counter 29 adjacent the sink 31. The sink has a drain 35 which empties into a reservoir container 33 through a pipe 31' which extends downward from the drain into the container 33 for emptying fluids from the sink 31 into the container 33, which may be removed from its position for emptying from time to time. The supply container 32 has a water pipe 36 which extends up and is connected to an electrical vacuum pump 37 provided beneath the sink 31. The vacuum pump also has an electrical heating coil and has two outlets, one leading to the faucet 34 and the other leading to faucet 35. The opening of valve 34' of faucet 34 causes the heating coil in the pump to be activates and also causes the water from the pump to travel out the faucet 34 with the water heated, its pump action being connected to the pipe 36 so that water from the supply container 32 maybe pumped heated electrically out the container 32 along the water pipe and out through the faucet 34 into the sink. If the valve 35' of faucet 35 is opened the pump is also activated and the water will be pumped out of faucet 35. The heating coil is not activated so that the water that comes out of faucet 35 will be cold. An external electrical outlet is provided (not shown) to provide electrical power to the outlets 35 and vacuum pump 37.

Figure 2:
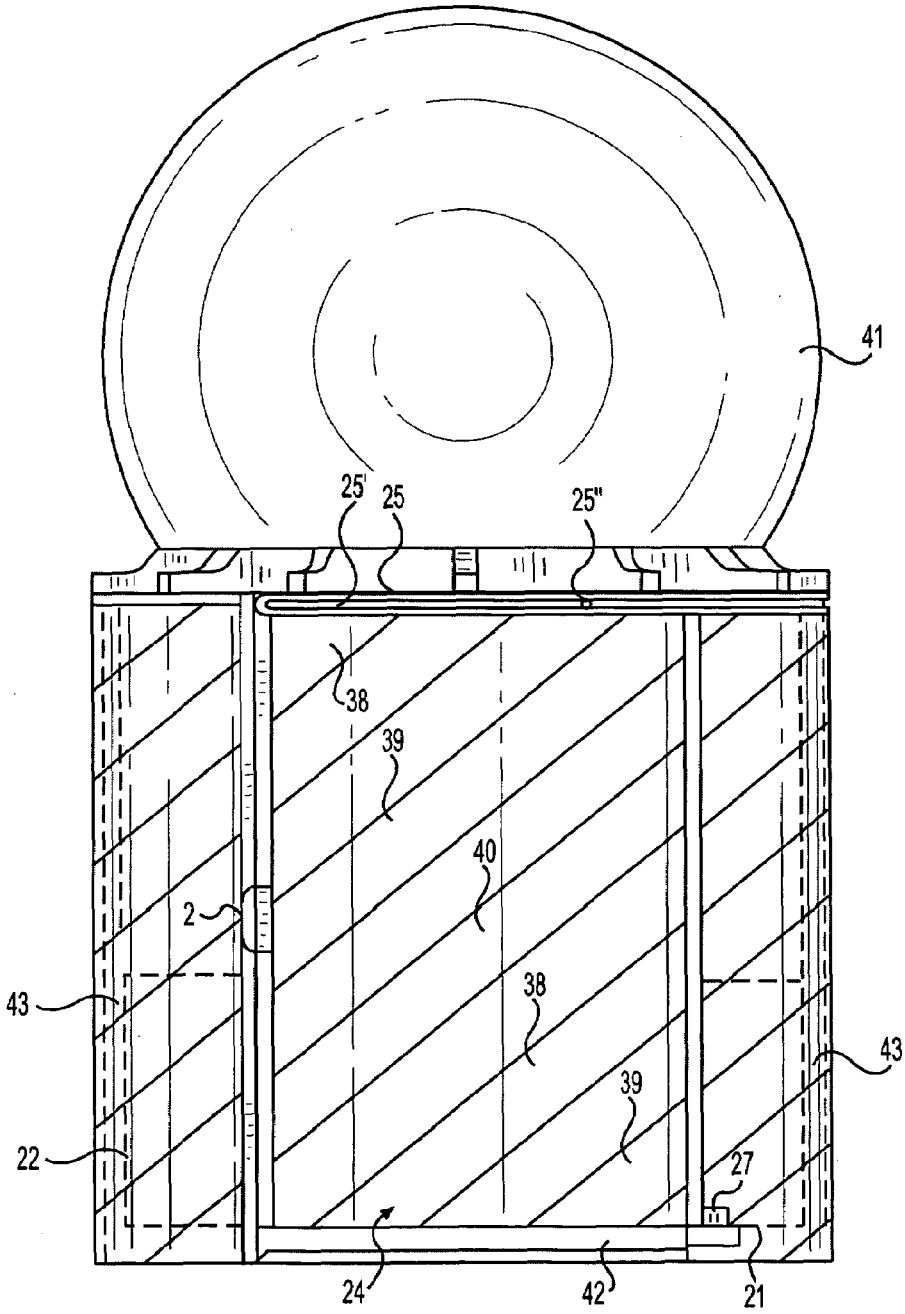
FIG. 2 is a side elevational view of the barber pole shaped barbershop with the barbershop door closed.
Figure 3:
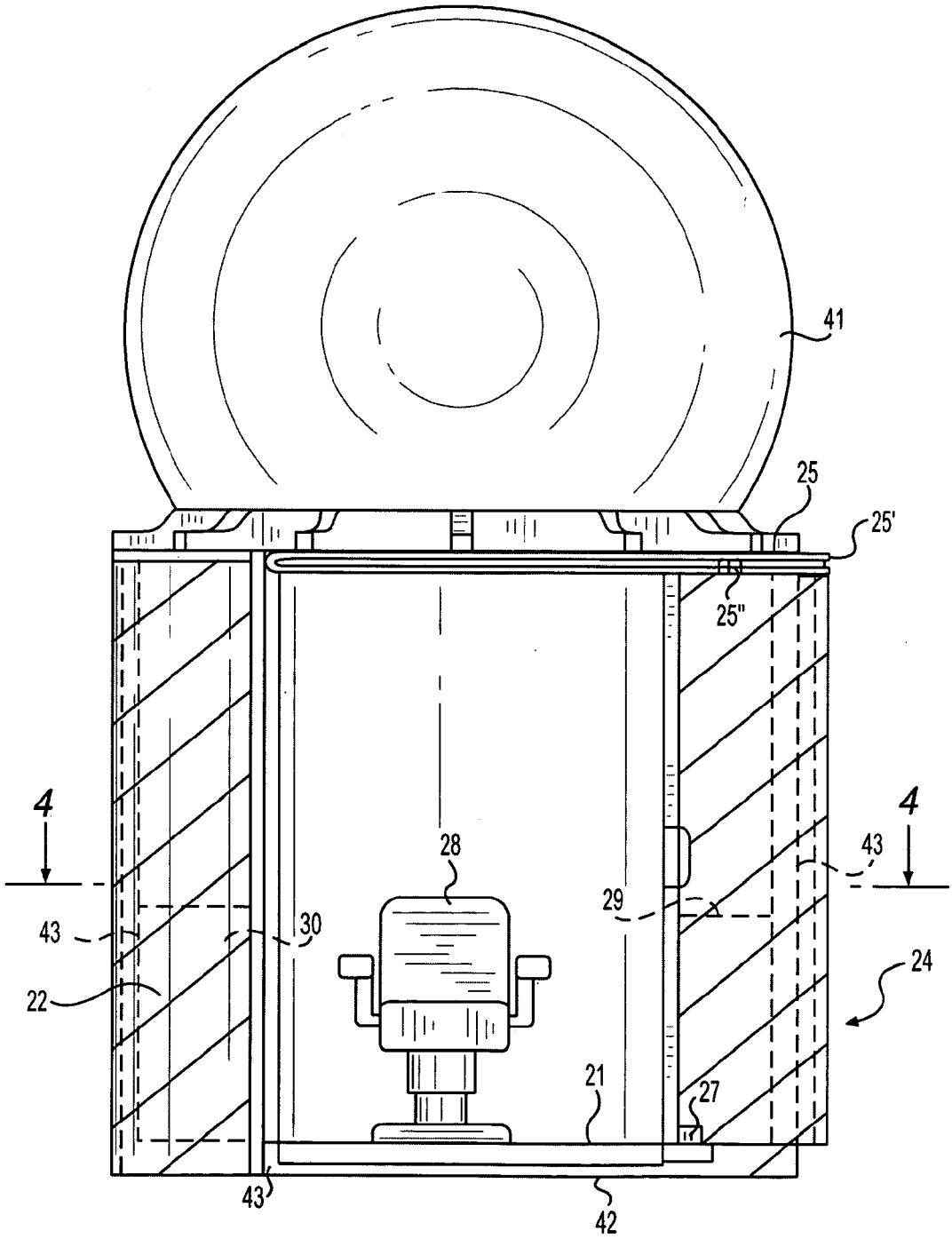
FIG. 3 is a side elevational view of the barber pole shaped barbershop with the barbershop door open.
Figure 4:
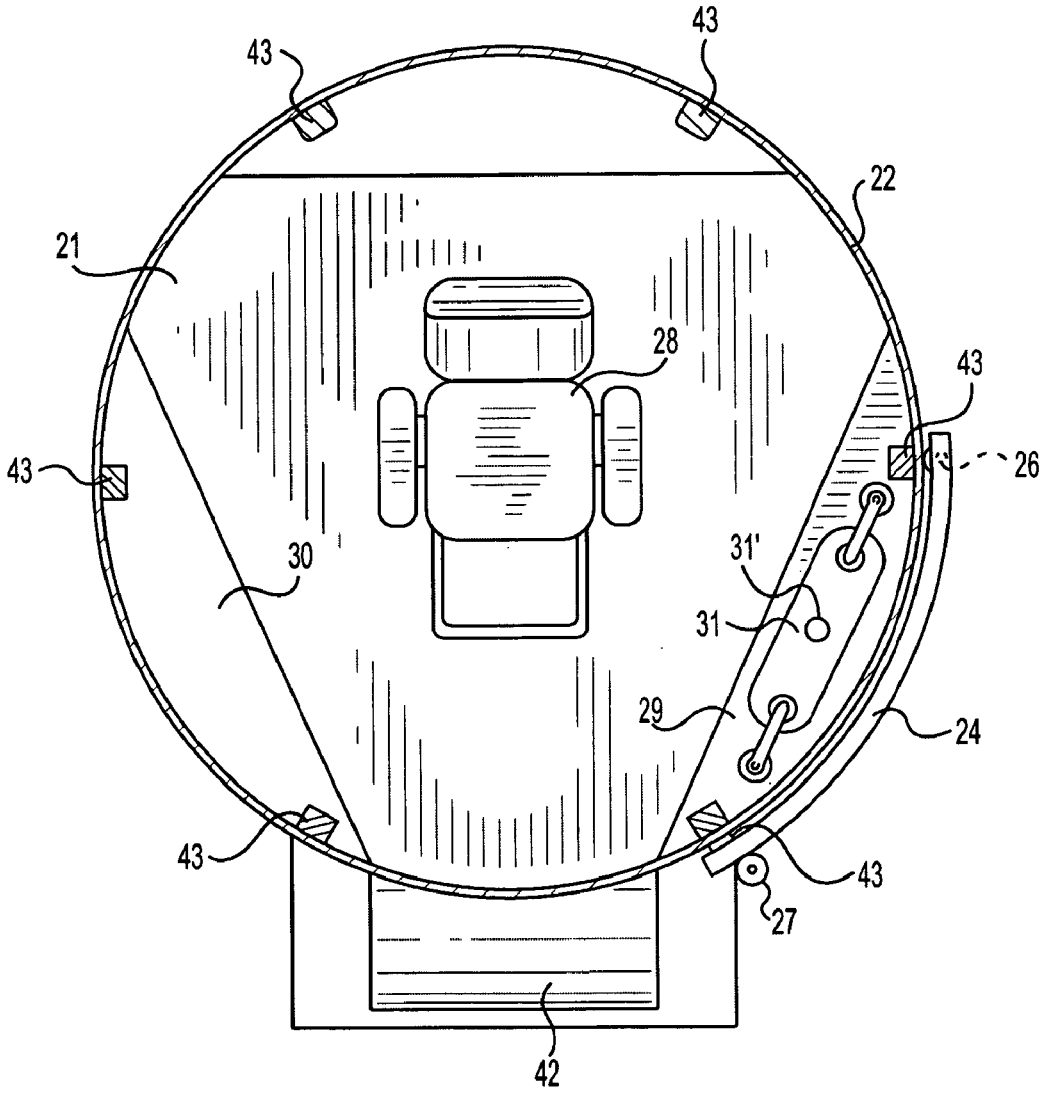
FIG. 4 is an alternate view of the invention.
Figure 5:
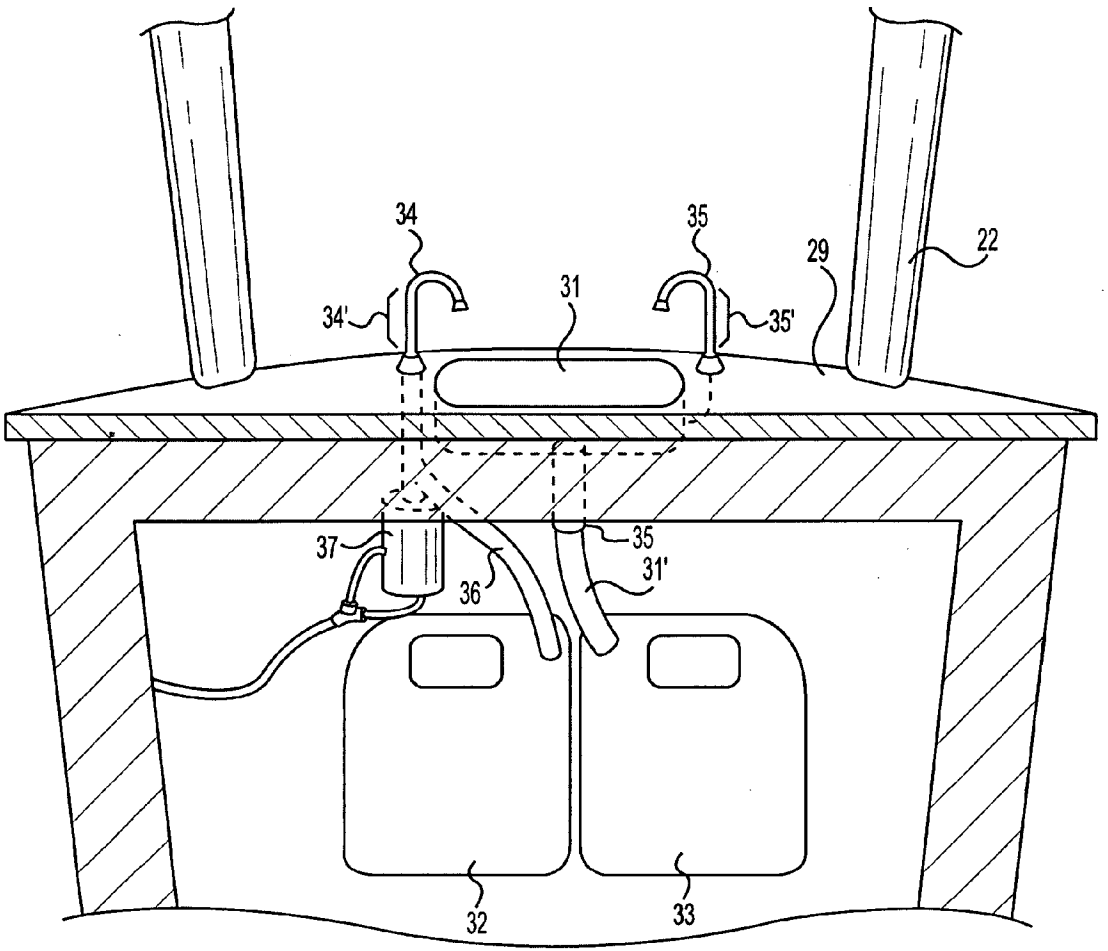
FIG. 5 is a second alternate view of the invention.

The cylindrical exterior of the wall is painted with red white and blue stripes 38, 39 and 40 respectively. A large white globe 41 is mounted on top of the cylindrical wall 22 so that the entire structure has the color and configuration simulating a barber pole as shown in FIGS. 1 and 2.

A slanted walkway or ramp 42 is provided at the door opening 23 which rests on the floor adjacent the compartment and slants upward with its inner edge 42' even with the top of the floor or base 21 so that people in wheelchairs and the like may easily roll a chair from the floor upon which the invention rests up level with the top surface of the floor or base 21.

The clear plastic cylindrical wall 22 is made of clear plastic with the plastic painted the red 38, white 39, and blue 40 stripes. The clear plastic cylindrical wall 22 is supported by six spaced aluminum poles 43 fixed in the floor 21.

A plurality of radial ribs 44 fixed together at their center axis in a radial pattern rest across the top portion, of the clear plastic cylindrical wall 22 and the globe 41 rests on top the radial ribs 44 and supported in turn thereby. The door 24 is also made of clear plastic and painted with the red, white, and blue stripes to synchronize to the wall and has a handle 24'.

It is intended that the mobile barbershop structure be placed in malls, various public places and corridors where allowable by permission of law, and be stored in and out of the way location in the mall or public place with the door closed. When used as a barbershop, the structure may be moved to a suitable location for business as a barbershop and connected to an external source of electricity so that the electrical barber appliances can be used. Whereupon the structure may be used for grooming hair.

It will be obvious that various changes and departures may be made to the invention without departing from the spirit and scope thereof and accordingly it is not intended that the invention be limited to that specifically described in the specification or as illustrated in the drawings but only as set forth in the appended claims wherein:

What is claimed is:

1. A barber shop pole for barbering persons comprising a cylindrical upright hollow pole structure to receive full size adults for barbering therein having a floor at its interior bottom, a rectangular opening in one side of the pole, a fragmental arcuate door and arcuately parallel to the exterior shape of the pole slidably mounted to slide over the opening to close the opening so that when closed it gives the appearance of an entire pole about its entire exterior, a barber chair within the interior of the pole for receiving persons to be barbered, a table for receiving and storing barber paraphernalia, having an exterior curvature to match the barber pole so as to be received adjacent there to along its curved exterior, a globe mounted to the upper end of the pole having a major portion formed in excess thereof formed as a globe and only a minor portion received in the upper end of the pole, said globe having the appearance of a globe of a barber pole, said arcuate door and pole having spiraling stripes matching one another when the door is closed so as to form a largely uninterrupted spiraling of the colors, a sink and faucet in said table and connections for receiving water, a pair of reservoir containers mounted adjacent the table with one container for providing fluid into the faucet and the other for receiving the fluid that has been used after operating the faucet, a vacuum pump for pumping water from the supply container up through the faucet, a heating coil for heating the water traveling through the faucet.

* * * * *